US005667138A

United States Patent [19]

Crampton

[11] Patent Number: 5,667,138

[45] Date of Patent: *Sep. 16, 1997

[54] HAND HELD SPRAY DISPENSER SYSTEM

[75] Inventor: David C. Crampton, Westminster, Calif.

[73] Assignee: Par-Way Group, St. Clair, Mo.

[ * ] Notice: The term of this patent shall not extend beyond the expiration date of Pat. No. 5,492,275.

[21] Appl. No.: 440,324

[22] Filed: May 12, 1995

Related U.S. Application Data

[63] Continuation-in-part of Ser. No. 243,366, May 16, 1994, Pat. No. 5,492,275.

[51] Int. Cl.[6] ..... B05B 3/02; B05B 9/043

[52] U.S. Cl. ..... 239/225.1; 239/333; 239/337

[58] Field of Search ..... 239/333, 337, 239/246, 225.1, 537, 543, 544, 573; 222/383.1, 402.1

[56] References Cited

U.S. PATENT DOCUMENTS

| | | | |
|---|---|---|---|
| 3,701,478 | 10/1972 | Tada | 239/333 |
| 3,896,975 | 7/1975 | Follmer | 222/192 |
| 3,927,834 | 12/1975 | Tada | 239/359 |
| 4,646,969 | 3/1987 | Sorm et al. | 239/106 |
| 4,838,490 | 6/1989 | Nissels | 239/333 |
| 5,088,649 | 2/1992 | Hanson | 239/329 |
| 5,152,425 | 10/1992 | Baudin . | |
| 5,156,304 | 10/1992 | Battegazzore | 239/333 X |

*Primary Examiner*—Lesley D. Morris
*Attorney, Agent, or Firm*—James A. Quinton

[57] ABSTRACT

According to the invention, a hand held sprayer is provided. Fluid flows from a reservoir to a delivery passageway upon pulling or pressing an actuator such as an aerosol actuator or button, a trigger or finger pump button. A nozzle having an inlet and an outlet is rotatably mounted to the outlet of the delivery passageway. The nozzle rotates about a rotation axis through the center of the discharge end of the nozzle. The actuator of the hand held sprayer is interconnected to the rotatably mounted nozzle to provide rotation of the nozzle simultaneously with the dispensing of the liquid from the reservoir to the atmosphere. The nozzle rotates from about 90° to 360° about the axis of rotation. The resulting hand held sprayer is capable of dispensing viscous liquids having a viscosity of over 60 cps and delivering a desirable round spray pattern.

38 Claims, 18 Drawing Sheets

HAND HELD SPRAY DISPENSER SYSTEM

This is a continuation in part of Ser. No. 08/243,366 filed May 16, 1994 Now U.S. Pat. No. 5,492,275.

TECHNICAL FIELD

The present invention relates to improvements in hand held spray dispensers particularly in hand pump dispensers and aerosol dispensers.

BACKGROUND ART

Aerosol containers have been in widespread use for dispensing of a variety of products. These dispensers have been of particular value in dispensing viscous liquids. Commonly, a hydrocarbon propellant has been used with viscous products particularly viscous hydrocarbon based products. Under pressure in an aerosol container, hydrocarbon propellant serves as a diluent and thus reduces the viscosity and surface tension of the viscous liquid. See for example U.S. Pat. No. 3,896,975. Efforts are now under way to eliminate hydrocarbon propellants from the environment. Freon has already been banned, out of concern for the ozone layer. Other hydrocarbons such as isobutane and propane and other volatile organic compounds (VOCS) have been identified as contributing factors in air pollution in urban areas. Thus, such propellants are undesirable and need to be removed from the spray containers.

Hand pump sprayers of the trigger type are known in the art. See U.S. Pat. Nos. 3,701,478 3,927,834 and 4,646,969 and U.S. Pat. No. 5,088,649.

Pump sprayable dispensing systems for viscous liquids have been developed in the prior art. For example, U.S. Pat. No. 5,088,649 describes a hand pump sprayer which can dispense a fine spray of viscous liquid without the need of using hydrocarbon propellants or other diluents. The fluid delivered by the hand pump sprayer of the '649 patent exists from the nozzle in two streams which collide at a point exterior to the nozzle assembly. The resulting spray pattern of such a sprayer is fan shaped. However, there are some applications where a fan shaped pattern is inconvenient.

Aerosol containers having colliding streams to improve breakup of viscous fluids have been provided. See U.S Pat. No. 5,249,747. The resulting spray pattern is fan shaped. However many applications require the traditional circular pattern provided by conventional aerosol containers.

Sprayers which have nozzles which can be rotated about their delivery passageway to allow the user to select different predetermined shaped nozzle holes are known. See U.S. Pat. No. 4,838,490. Pump sprayers which allow the movement of the nozzle outlet between two extreme positions during dispensing of the fluid are known in the art. See U.S. Pat. No. 5,152,425.

DISCLOSURE OF INVENTION

The present invention is directed to hand held sprayers. Particularly the invention relates to aerosol spray containers, hand pump sprayers preferably of the trigger type or the finger pump type. The invention also relates to a system for dispensing viscous liquids. The hand held sprayer according to the invention provides improved atomization and a circular spray pattern. A nozzle rotating mechanism is provided for rotating the nozzle simultaneously with dispensing fluid to the atmosphere. According to the invention, a nozzle is rotatably mounted to a hand held sprayer so that the nozzle simultaneously rotates as fluid is dispensed to the atmosphere. Desirably, the nozzle is rotated when the fluid actuator of the hand held sprayer is engaged so that rotation occurs simultaneously with the discharge of fluid product to the atmosphere. The nozzle rotates about an axis of rotation through the center of the discharge end of the nozzle through an angle of rotation of from about 90° to about 360°, desirably from 180° to 360° and preferably 270° or more. Desirably the nozzle has two discharge outlets which direct fluid expelled from the spray dispenser along intersecting discharge axes. Simultaneously as the fluid is discharged along the intersecting axes, the nozzle is rotated about the axis of rotation. The resulting dispensed liquid has a high degree of atomization and a desirable round spray pattern.

It is an object of the invention to provide a hand held sprayer which gives improved atomization of the delivered liquid.

It is an object of the invention to provide a hand held sprayer which can dispense viscous products having a viscosity of 60 cps or greater in fine droplets.

It is an object of the invention to provide a hand held sprayer with improved atomization when spraying viscous and non-viscous liquids.

It is an object of the invention to provide a hand held sprayer which dispenses viscous products in a round spray pattern.

It is an object of the invention to provide a viscous fluid dispensing system which can readily spray viscous products having a viscosity over 60 cps in fine droplets in a round spray pattern.

It is an object of the invention to provide an effective viscous edible organic oil dispensing system in a closed pressurized container that is free of hydrocarbon propellants and that provides a round spray pattern.

It is an object of the invention to provide a hand held sprayer with a nozzle that rotates about 180° to 360° about an axis of rotation through the center of the nozzle outlet end as the liquid is expelled to the atmosphere.

According to the invention a hand held sprayer which provides improved atomization and a round spray pattern is provided. The hand held sprayer is versatile and can be used with a variety of different viscosity fluids. The sprayer is particularly useful in spraying viscous liquids with a viscosity over 60 cps.

In the prior art, it was difficult if not impossible to pump viscous liquids with a hand pump sprayer and obtain sufficient atomization to deliver the fluid in fine droplets. This problem was substantially remedied by U.S. Pat. No. 5,088,649 which is incorporated by reference herein. In the '649 patent a hand pump sprayer of the trigger type is provided. The '649 sprayer has a first and second discharge axis. The liquid expelled from the '649 sprayer intersects at a collision point exterior to the nozzle outlets and collides to enhance the breakup of the fluid to small droplets. The resulting spray pattern is generally fan shaped.

In the prior art, it was difficult to provide aerosol dispensed viscous fluids having a viscosity over 60 cps without using a diluent. The prior art has relied on freon, butane, pentane and other VOC (volatile organic compound) propellant which are both a pollution problem and a fire hazard. This propellant dissolves in the oil and reduces its viscosity. U.S. Pat. No. 5,249,747 provided an acceptable aerosol sprayer using non organic propellants such as nitrogen, carbon dioxide, nitrous oxide or argon. However, like the sprayer of the '649 patent, the spray pattern is fan shaped.

Many users of spray dispensable products desire the typical aerosol type spray pattern with its centered outlet which delivers a round spray pattern. Many consumers use round skillets or other such cooking surfaces and desire a round spray pattern. In addition, it is desired that the hand held sprayer be usable with viscous liquids without resorting to VOC diluents. Typical aerosol containers and hand pump sprayers have centered discharge outlets in their nozzles. Both aerosol and hand pump sprayers generally deliver a spray in a round pattern. However, in the typical hand pump sprayer, viscous fluids are not sufficiently atomized. In the typical aerosol sprayer, viscous organic fluid particularly vegetable oil could not be provided in a fine mist without the use of hydrocarbon propellants that would reduce the viscosity of the vegetable oil by forming a solution therewith in the aerosol container.

According to the invention a, spray dispenser particularly a hand held sprayer is provided. The hand held sprayer may be of several types. It may be a closed pressurized container, such as an aerosol container or a bladder pack. See, for example, U.S. Pat. No. 4,510,734. It may be a hand pump sprayer, for example a trigger type hand pump sprayer or a finger pump hand pump sprayer. Fluid flows from a reservoir to a delivery passageway upon pulling or pressing an actuator such as an aerosol actuator or button, a trigger or finger pump button. A nozzle having an inlet and an outlet is rotatably mounted to the outlet of the delivery passageway. The nozzle rotates about a rotation axis through the center of the discharge end of the nozzle. Preferably the nozzle is one that provides colliding streams of fluid intersecting at a point outside the nozzle such as described in the U.S. Pat. No. 5,088,649 (Hanson). Alternatively, a nozzle having a single hole which is eccentric that is, off center from the axis of rotation of the nozzle is provided. The actuator of the hand held sprayer is interconnected to the rotatably mounted nozzle to provide rotation of the nozzle simultaneously with the dispensing of the liquid from the reservoir to the atmosphere. The nozzle rotates from about 90° to 360° about the axis of rotation, most preferably from 180° to 360° . The resulting hand held sprayer is capable of dispensing viscous liquids having a viscosity over 60 cps and delivering a desirable round spray pattern. In addition, the sprayer of the invention provides increased atomization and misting over that of a conventional sprayer regardless of the viscosity of the liquid pumped.

According to the invention, the hand held sprayer desirably has a drive gear interconnected and operatively driven by the actuator of the hand held sprayer. The drive gear is interconnected to a nozzle drive gear which is operatively interconnected to the nozzle. The nozzle drive gear rotates the nozzle about an axis of rotation through the center of the delivery end of the nozzle. The nozzle rotates about the axis of rotation from 90° to about 360° and preferably from 180° to 360° and most preferably 270° or greater simultaneously with the dispensing of the pressurized fluid to the atmosphere by the action of pressing or pulling the actuator.

The preferred embodiment of the present invention is illustrated in the drawings and examples. However, it should be expressly understood that the present invention should not be limited solely to the illustrative embodiment.

BEST MODE FOR CARRYING OUT INVENTION

Figure 1:
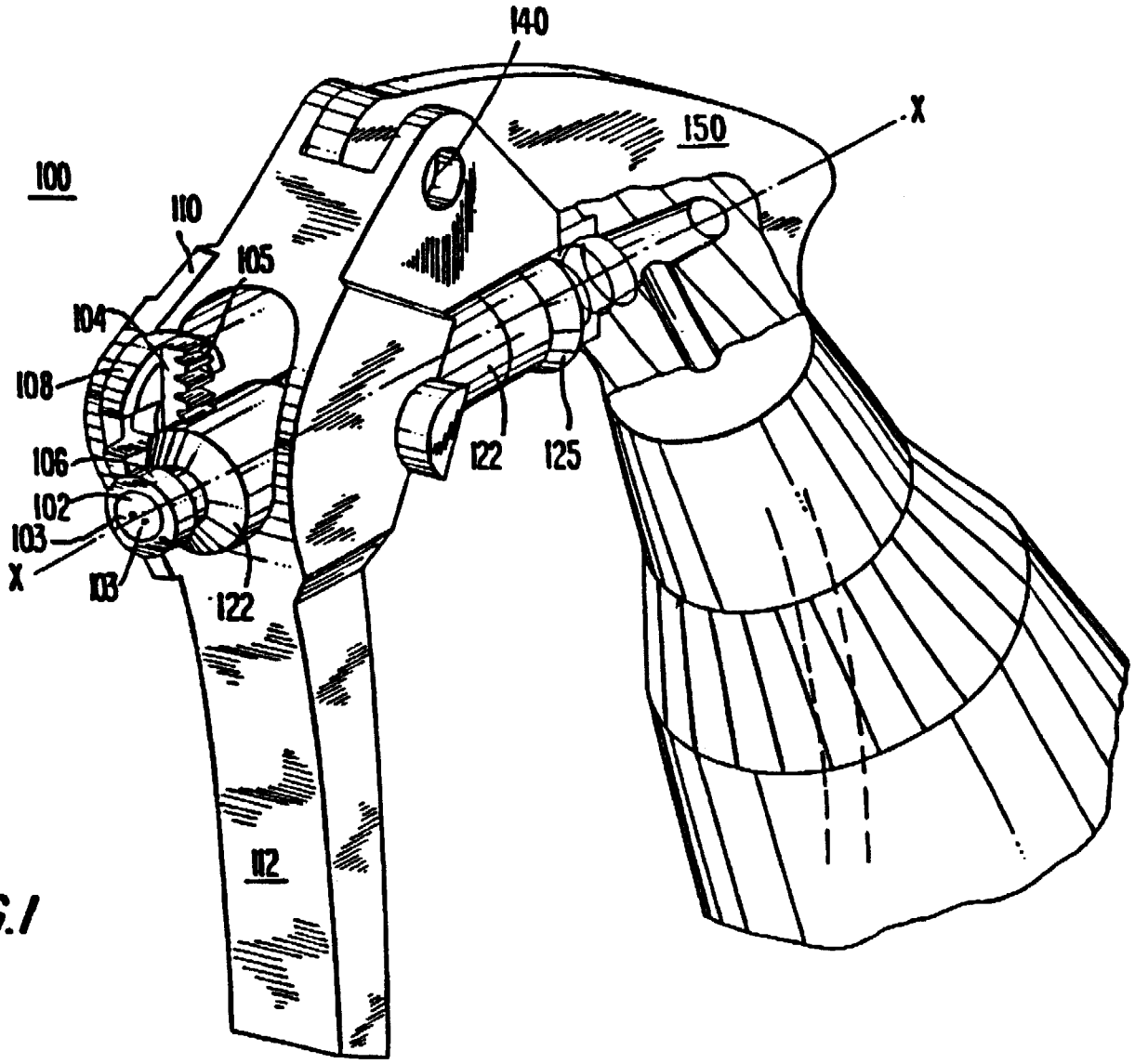
FIG. 1 is a perspective view of the hand held sprayer according to the invention.

The present invention relates to a spray dispenser for dispensing of a variety of different liquids. The invention also relates to a system for dispensing viscous fluids. According to the invention the spray dispenser, preferably a hand held sprayer has a nozzle which rotates about an axis X of rotation through the center of the discharge end of the nozzle through an angle of rotation from 90° to 360° preferably from 180° to 360° and most preferably 270° or more simultaneously with the dispensing of fluid to the atmosphere. The nozzle is interconnected to the actuator of a hand held sprayer so that the nozzle is rotated by pushing an actuator button or pulling a trigger or the like. Simultaneously with the nozzle rotation, pressurized fluid is delivered from a reservoir of the hand held sprayer to the atmosphere upon the action of pushing or pulling the actuator. The nozzle can have a variety of different discharge outlets. Preferably the nozzle has two discharge outlets which are spaced apart and provide colliding streams of fluid intersecting at a point outside the nozzle such as described in U.S. Pat. No. 5,088,649. Preferably the outlets are on opposite sides of the axis X of rotation. Optionally three or more colliding streams emanating from three or more outlets can be provided. Alternatively a single discharge outlet can be provided. In such instance the discharge outlet is eccentric to the axis of rotation of the rotating nozzle. The resulting hand held sprayer provides superior atomization of the sprayed liquid and at the same time provides the desirable round spray pattern.

The hand held sprayer according to the invention is particularly useful with viscous liquids having a viscosity of 60 cps or greater. Most preferably the invention is useful for spraying viscous liquids having a viscosity from 60 cps to 100 cps and preferably from 60 to 85 cps and most preferably from 70 to 85 cps. A wide range of viscous products can be dispensed in a fine mist. For example, vegetable oil, vegetable oil lecithin mixtures, paint without volatile organic compounds (VOCS) diluents, e.g. paint pigments in linseed oil, viscous petroleum products, viscous lubricants, adhesives, resins, e.g. hair spray having a viscosity of 60 cps or greater are contemplated according to the invention. Preferably the sprayer according to the invention is used to dispense viscous vegetable oil containing compositions, most preferably vegetable oil lecithin mixtures. Optionally, non-viscous liquids may be used in the sprayer according to the invention such as water or alcohol based window cleaners, household cleaners or other water based products. Such liquids are sprayed in a fine mist with superior atomization and a round spray pattern.

According to the invention, a hand held sprayer is provided which has a nozzle which rotates about an axis X through the center of the outlet end of the nozzle through an angle of rotation of from 90° to 360° preferably from 180° to 270° and most preferably over 270° simultaneously with dispensing of product from the sprayer reservoir to the atmosphere.

According to the invention, the hand held sprayer can be a closed pressurized container such as an aerosol container or a bladder pack. Alternatively, the hand held sprayer can be a hand pump sprayer, such as a trigger type or a finger pump type.

In the aerosol embodiment according to the invention, an aerosol propelled viscous fluid containing system is provided. In particular, an aerosol packaged viscous vegetable oil containing system can be provided which can use non hydrocarbon propellants such as nitrogen, carbon dioxide, nitrous oxide, argon, air or inert gases, preferably carbon dioxide or nitrogen. The resulting system provides a round spray pattern while dispensing the viscous fluid in small droplets or fine mist without the need to use freon or VOC (e.g. butane or pentane) propellants. Preferably, the aerosol container according to the invention has a button actuator which opens a valve to the aerosol container to allow pressurized fluid to flow to the delivery passageway. The nozzle is operatively rotated by the action of the aerosol actuator preferably a button. Preferably, the nozzle is rotated by a nozzle drive gear which imparts rotational movement to the nozzle as the aerosol actuator is pushed down and returned to its upward position. Preferably, the nozzle drive gear is a pinion which is rotated by a rack attached to the actuator button which engages the pinion when the actuator button is pressed downward to open the valve in the aerosol. Desirably, a metered valve such as the EMSON MP320 from Emson, Inc. Bridgeport, Conn. which allows the release of pressurized fluid for a pre-determined amount of time is used. Such valves shut off when the actuator button has been fully depressed. As a result, aerosol fluid will be delivered to the atmosphere simultaneously with the rotation of the nozzle.

Referring now to FIGS. 11 through 15, an aerosol container preferably can 200 is provided according to the invention. An actuator extension button 202 having a hollow interior 203 is provided. A nozzle rotation mechanism is provided for rotating the nozzle simultaneously with the dispensing of fluid to the atmosphere. The nozzle rotation mechanism is preferably interconnected to the actuator 204 of the aerosol can 200. Desirably the actuator extension button 202 includes a slot 201 having a rack 206 extending along a vertical side wall of slot 201. An aerosol actuator 204 having an open top 240 and a hollow upper interior portion 209 for receipt of actuator extension button 202 is provided. Aerosol actuator 204 is preferably a male actuator having a stem 248 for activation of a conventional female aerosol valve. Optionally, a female actuator can be used if a male aerosol valve was installed in the aerosol can 200. The aerosol extension button 202 slides into the hollow 209 of aerosol actuator 204.

A spring 208 is provided between actuator extension button 202 and aerosol actuator 204. Spring 208 is supported by a spring seat preferably circular shelf 242 in aerosol actuator 204. A retainer ledge 205 is provided on aerosol actuator 204 for snap engagement with retainer shoulder 207 on actuator extension button 202 to hold actuator extension button 202 in place. A nozzle housing 210 preferably integrally formed in aerosol actuator 204 is provided for receipt and retention of nozzle sleeve 232. Nozzle housing includes outlet 211. A pinion assembly 212 is provided which includes pinion 216, pinion seal 214, ring seat 218, nozzle barrel 225 and nose 228. Pinion 216 preferably has a seal 214 integrally attached to its inlet end, and a pinion passageway 217 for receipt of pressurized fluid from delivery passageway 250. Preferably, a ring seat 218 is attached to the opposite end of pinion 216 opposite seal 214. Desirably, ring seat 218 is integral with pinion 216. Optionally, a swirl chamber is provided to swirl the fluid prior to its reaching outlets 238. A circular groove 220 is provided on the front of ring seat 218. Orifice 222 is provided in pinion 216 for discharging fluid from pinion passageway 217. Nozzle barrel 225 is connected to the outlet end of pinion 216 and is joined to pinion 216 through ring seat 218. Fluid flows out from orifice 222 along four (4) grooves 224 in nozzle barrel 225. Nose 228 is provided having a nose mounting rod 229 for mounting nose 228 to nozzle barrel 225 through mounting hole 226 in nozzle barrel 225. Optionally, swirl grooves, not shown, are provided on back of nose 228 to swirl the fluid flowing from grooves 224 prior to dispensing to the atmosphere. Two channels 230 are provided on top of nose 228 for mating with corresponding channels 236 in nozzle sleeve 232. A retainer recess 234 is provided on nozzle sleeve 232 for snap engagement in nozzle housing 210 with a mating projection on the interior 211 of nozzle housing 210.

Alternatively, pinion 216 can be directly connected to a nozzle having drilled outlets. In such embodiment the nose and swirl channels are preferably eliminated.

In assembling the aerosol can 200 according to the invention, spring 208 is placed in hollow 209 of aerosol actuator 204. Actuator extension button 202 is mounted to actuator 204 by snapping button 202 in place and engaging retainer shoulder 207 with retainer ledge 205 in aerosol actuator 204. The pinion assembly 212 is slipped into nozzle housing 210 for fluid engagement of pinion passageway 217 with delivery passageway 250. The pinion assembly 212 slips through outlet 211 and through nozzle housing 210. Pinion 216 extends into hollow interior 209 so that it operatively meshes with rack 206. Pinion assembly 212 is held in place by nozzle sleeve 232 which is in snap engagement with nozzle housing 210 through retainer recess 234. Nozzle barrel 225 is mounted to pinion through ring seat 218 on pinion 216. Nose 228 having nose mounting rod 229 slides into nose mounting hole 226 located in nozzle barrel 225. Nozzle sleeve 232 is interconnected to nozzle barrel 225 and to pinion 216 so that as pinion 216 rotates so does nozzle sleeve 232. Outlet orifices 238 are formed from channels 236 in nozzle sleeve 232, mating with channels 230 in nose 228. Optionally, a nozzle having drilled holes directly connected to the pinion as shown in FIG. 1 for a trigger sprayer can be used.

Figure 14:
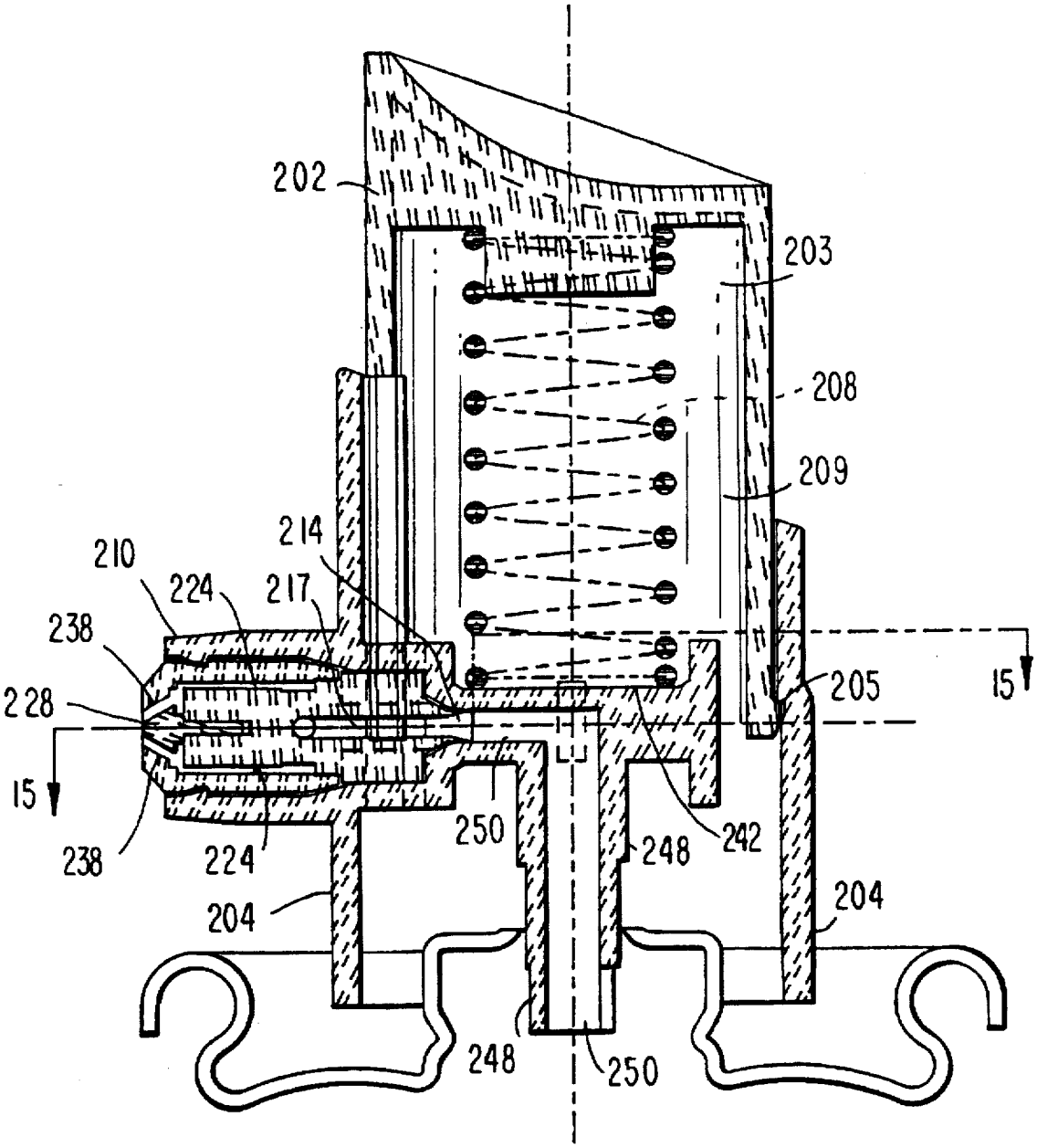
FIG. 14 is a sectional view through 14—14 of FIG. 13.
Figure 15:
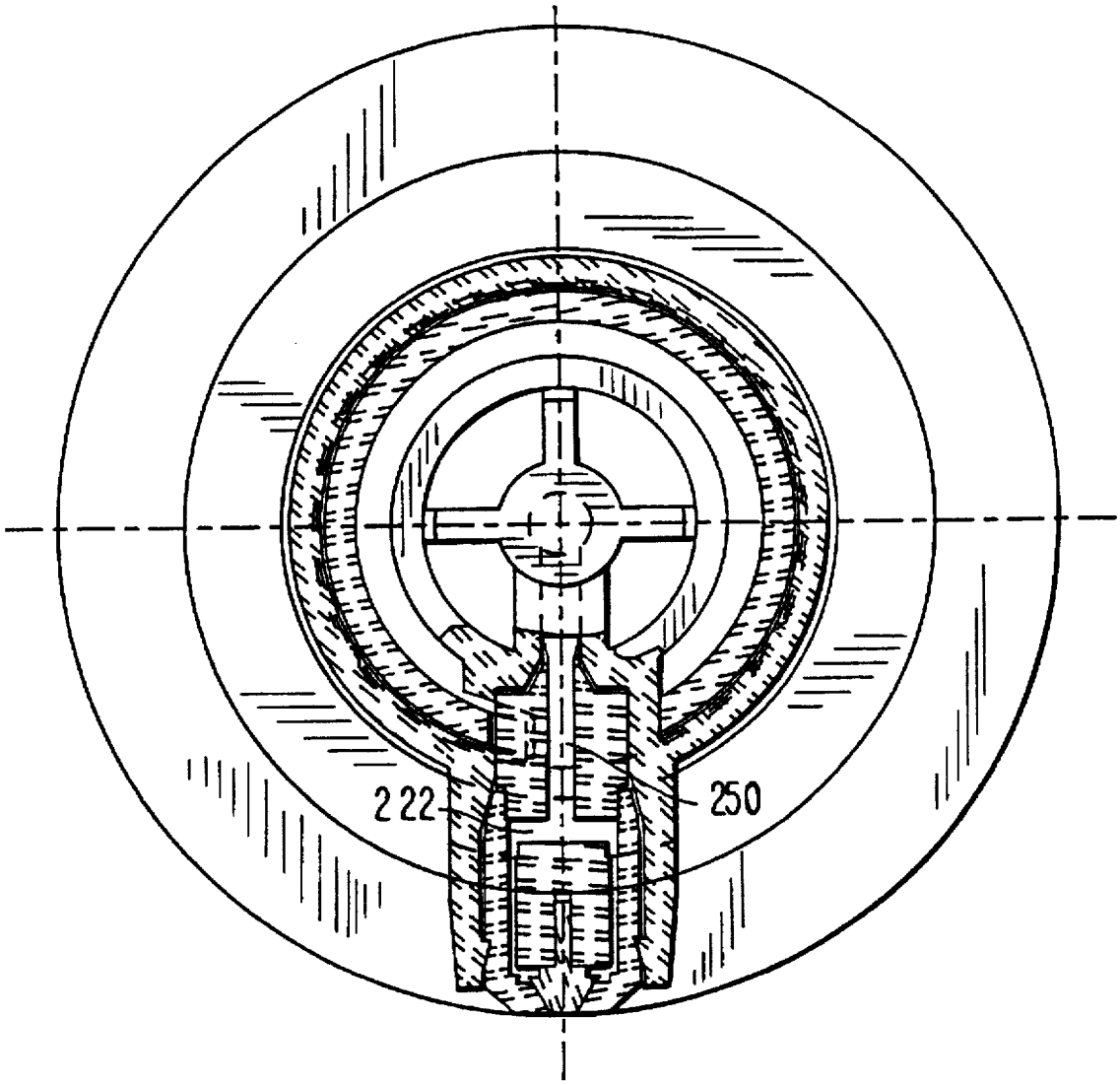
FIG. 15 is a sectional view through 15—15 of FIG. 14.

In operation, as best seen in FIG. 14, actuator extension button 202 is depressed by the user thereby compressing the spring 208. Aerosol actuator 204 is depressed and aerosol valve (not shown) is opened by stem 248. Stem 248 pushes down on a conventional aerosol valve, for example, an Emson Metered Valve MP 340 from Emson Inc., Bridgeport, Conn. Fluid flows into delivery passageway 250 through a liquid opening to channel 217 in pinion 216. As actuator extension button 202 is depressed, rack 206 rotates pinion 216. Pinion 216 is attached to nozzle sleeve 232 and rotates nozzle sleeve 232 as pinion 216 is rotated by the travel of rack 206. As a result, the nozzle is rotated around axis X simultaneously with the release of fluid to the atmosphere. Desirably, the nozzle rotates from 90° to 360° , preferably from 180° to 360° and most preferable 270° or greater. When the user has completed pushing down on actuator extension button 202 to the completion of its travel, the actuator extension button should be released, as this will stop the release of fluids to the atmosphere. Alternatively, a metered valve can be used which shuts off as soon as the button has been fully depressed. When the actuator extension button 202 is released by the user, spring 208 returns actuator extension button 202 back into position for reuse.

In another aspect of the invention, a sprayer of the finger pump type using a generally conventional plunger arrangement is provided. A nozzle rotating mechanism for rotating the nozzle from 90° to 360° preferably 180° to 360° most preferably 270° or greater simultaneous with the dispensing of fluid in a fine mist to the atmosphere is provided. Desirably the nozzle is rotated by a nozzle drive gear which imparts rotational movement to the nozzle as the finger pump actuator is moved up and down. There are a wide variety of gear arrangements possible. Desirably, the nozzle can be rotated by the interaction of a pinion attached to the nozzle interacting with a stationary rack.

Figure 16:
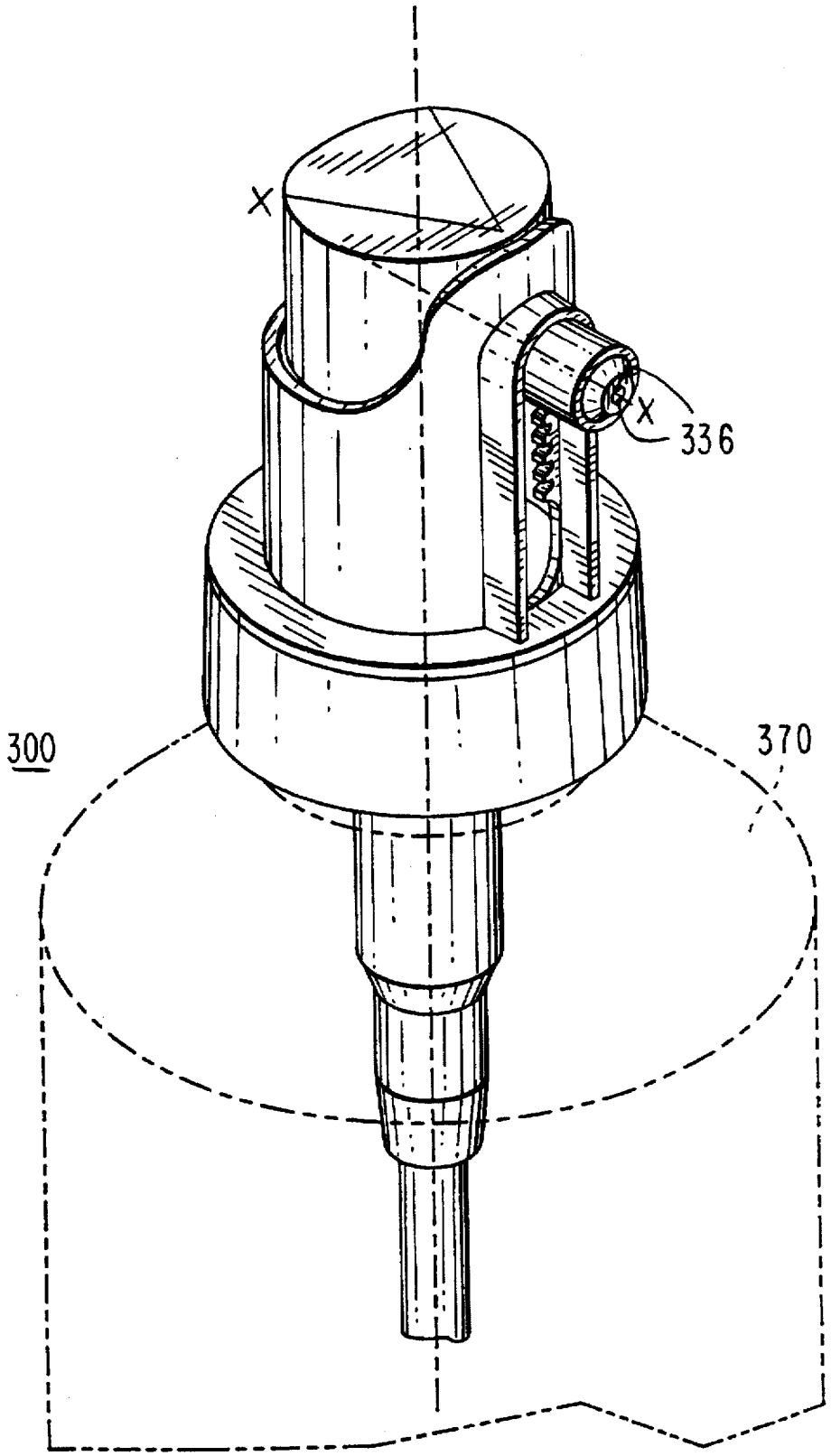
FIG. 16 is a perspective view of the finger pump spray dispenser according to the invention.
Figure 17:
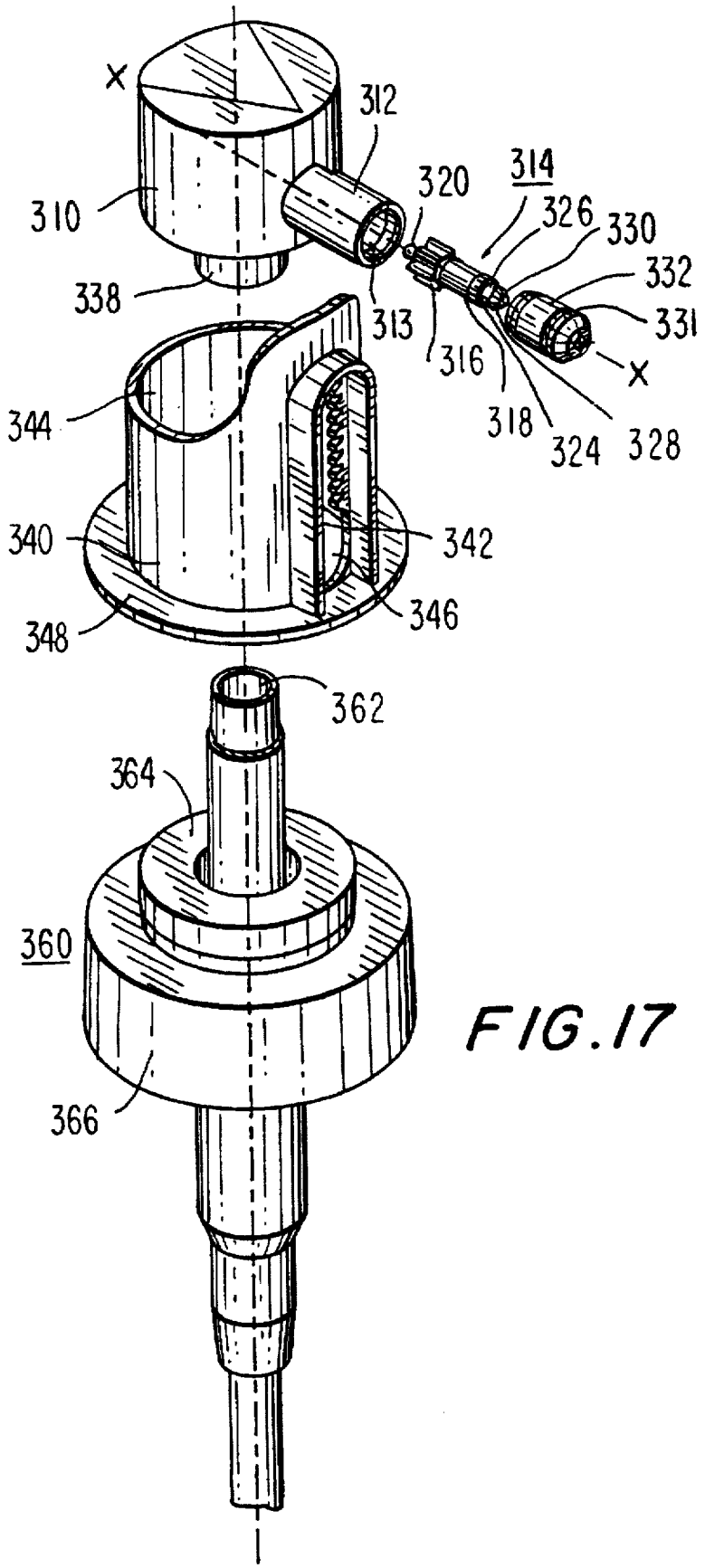
FIG. 17 is an exploded view of the finger pump sprayer separated from the reservoir.
Figure 18:
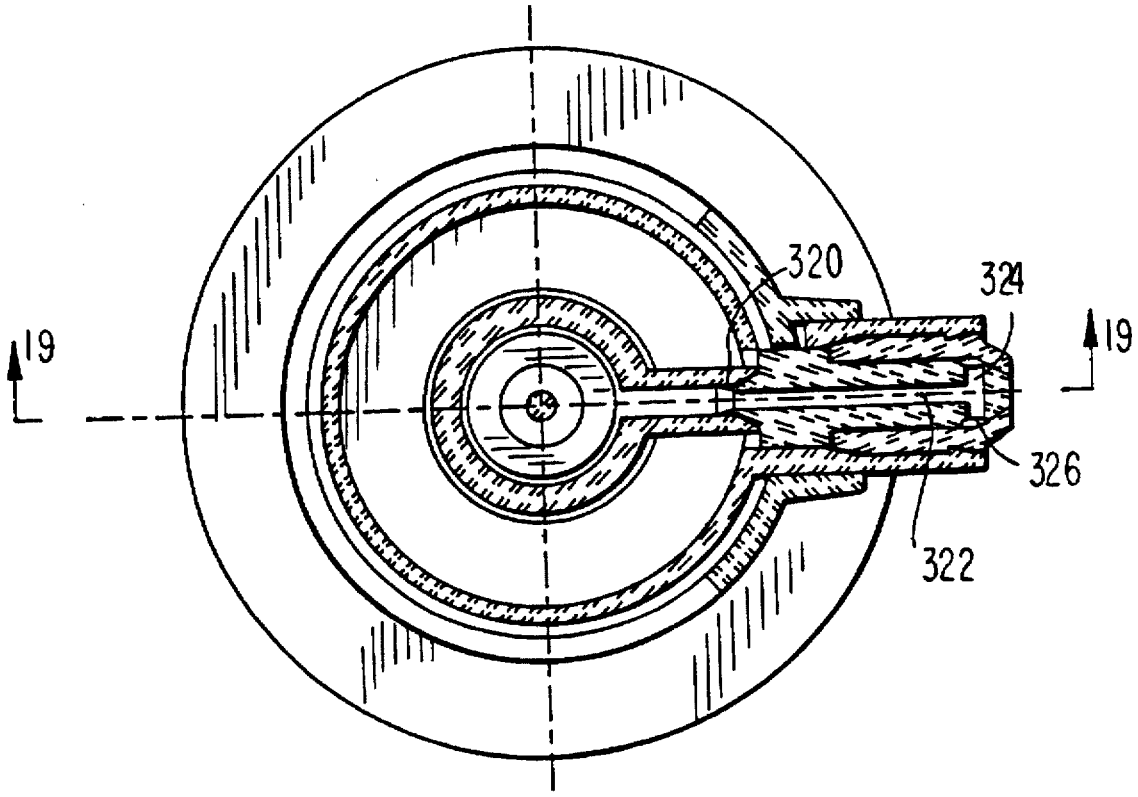
FIG. 18 is a top sectional view through axis X of FIG. 16.
Figure 19:
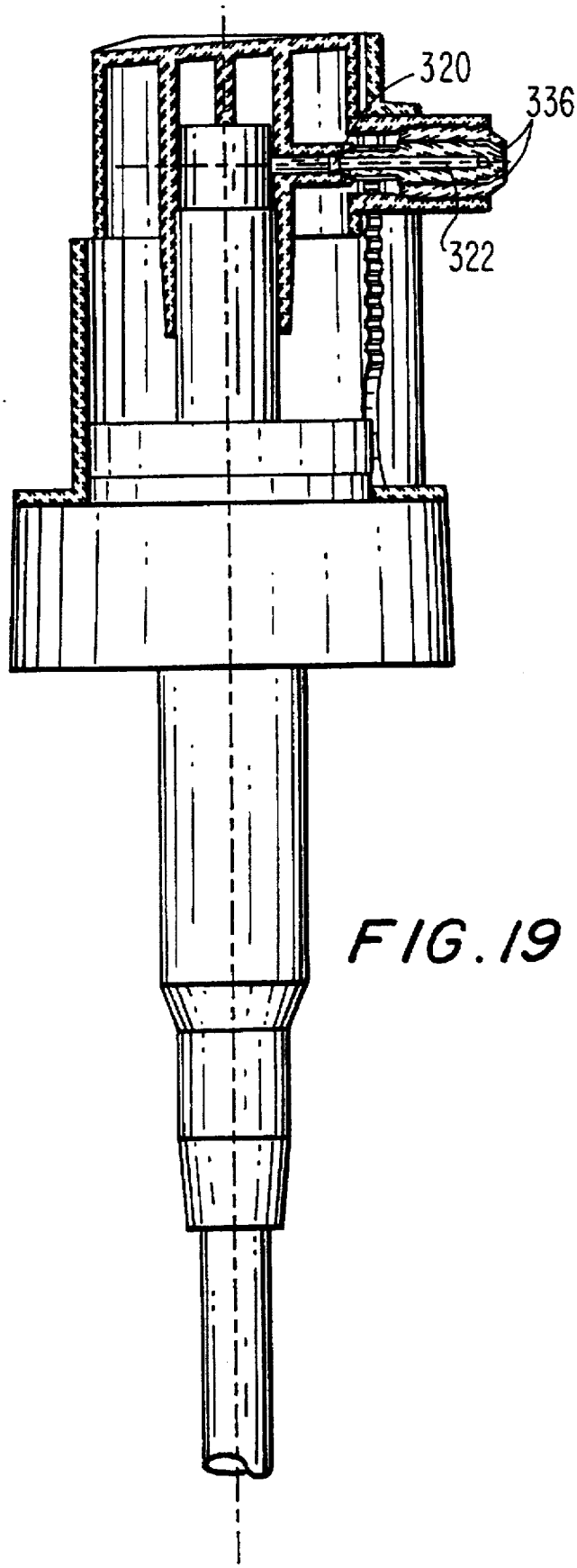
FIG. 19 is a section through 19—19 of FIG. 18.

Referring to FIGS. 16–19, a finger pump sprayer 300 is provided having an actuator button 310 for interconnection with a conventional finger pump mechanism 360. Preferably, integral with the actuator button is a nozzle housing 312. A pinion assembly 314 is provided. As best seen in FIG. 17, pinion assembly 314 includes pinion 316, pinion seal 320; nozzle barrel 318 and nose 328. Attached to pinion 316 preferably integral with the pinion is nozzle barrel 318. The pinion 316 has a seal 320 at the inlet end. Passageway 322 extends through the pinion 316 and nozzle barrel 318 for the flow of fluid through the pinion from delivery passageway 362 leading from the conventional pump mechanism 360. Outlet 324 for the flow of fluid from passageway 322 is provided. A nose 328 is connected to the nozzle barrel 318 in a similar manner as shown in the aerosol embodiment of FIG. 11. Nose 328 has U shaped channels 330 on the surface thereof which are in fluid communication with circular groove 326 on nozzle barrel 318. Nozzle sleeve 332 includes interior U shaped nozzle channels which mate with channels 330 in nose 328 to form fluid outlets 336 when the nose and nozzle sleeve have been assembled together. Coupling 338 is provided at the bottom of button 310 for interconnection of the button with delivery passageway 362 of pump mechanism 360. Rack housing 340 has an opening preferably slot 346 on one side for receipt of the nozzle housing 312. Preferably slot 346 is generally rectangular. Preferable rack 342 is mounted to rack housing 340 on a side wall adjacent slot 346. Rack housing 340 includes interior passageway 344 for receipt of actuator button 310. Flange 348 is provided to sit on container cap 366. Rack housing 340 is mounted to pump 360 by snapping ring 364 into interior passageway 344. As best seen in FIG. 16, when assembled for use, nozzle housing 312 projects through slot 346 and button 310 is mounted into rack housing 340. Passageway 362 of pump mechanism 360 extends through interior passageway 344 of rack housing 340 and is linked to button 310 through coupling 338 to provide for fluid communication from the pump delivery passageway 362 to the nozzle housing 312. The finger pump sprayer 300 is assembled by mounting actuator button 310 to rack housing 340 by sliding nozzle housing 312 through slot 346. The actuator button then can freely move up and down in nozzle housing 340. Coupling 338 is snap fitted onto delivery passageway 362. The pinion assembly 314 is placed into nozzle housing 312. Pinion 316 extends a sufficient distance through nozzle housing 312 so that it operatively engages stationary rack 342 located on the side wall of rack housing 340 adjacent to slot 346. As indicated above, the nose 328 is attached to the nozzle barrel 318 and the nozzle sleeve 332 is pressure fitted to pinon assembly 314. An outlet is formed by the mating relationship of the U-shaped channels 330 in the nose 328 and corresponding channels 334 in the nozzle sleeve 332. A retainer recess 331 is provided on nozzle sleeve 332 for snap engagement in nozzle housing 312 with a mating projection on the interior 313 of nozzle housing 320.

In operation, the pump 360 is operated by the up and down movement of actuator button 310. The pinion 316 is rotated by the stationary rack 342 about axis X as the button 312 moves up and down, and fluid is pumped from reservoir 370. As a result, pressurized fluid is delivered to the atmosphere as the nozzle is simultaneously rotated.

In another aspect of the invention, a hand pump sprayer of the trigger type having a generally conventional plunger arrangement can be used to draw the liquid from the reservoir of the hand pump sprayer to the delivery passageway of the hand pump sprayer. See, for example U.S. Pat. No. 4,646,969 or U.S. Pat. No. 3,927,834 which are incorporated by reference. Desirably a Continental Model 922 modified to have a rotating nozzle is useful in the invention. The liquid is drawn from the reservoir and delivered under pressure to the nozzle through a delivery passageway upon the pulling of the trigger. The nozzle is operatively rotated by the action of the trigger of the hand pump sprayer. Preferably the nozzle is rotated by a nozzle drive gear which imparts rotational movement to the nozzle as the trigger is moved back and forth. There are a variety of gearing arrangements possible to translate the back and forth trigger movement to rotational movement of the nozzle. The nozzle drive gear can be directly driven by a rack attached to trigger as shown in FIGS. 1 to 10. In such instance the nozzle drive gear will in fact be a pinion interacting directly with a gear rack attached to the trigger. Alternatively, the nozzle drive gear can be driven indirectly by the trigger through several gears which are ultimately operated by the back and forth movement of the trigger.

Figure 1A:
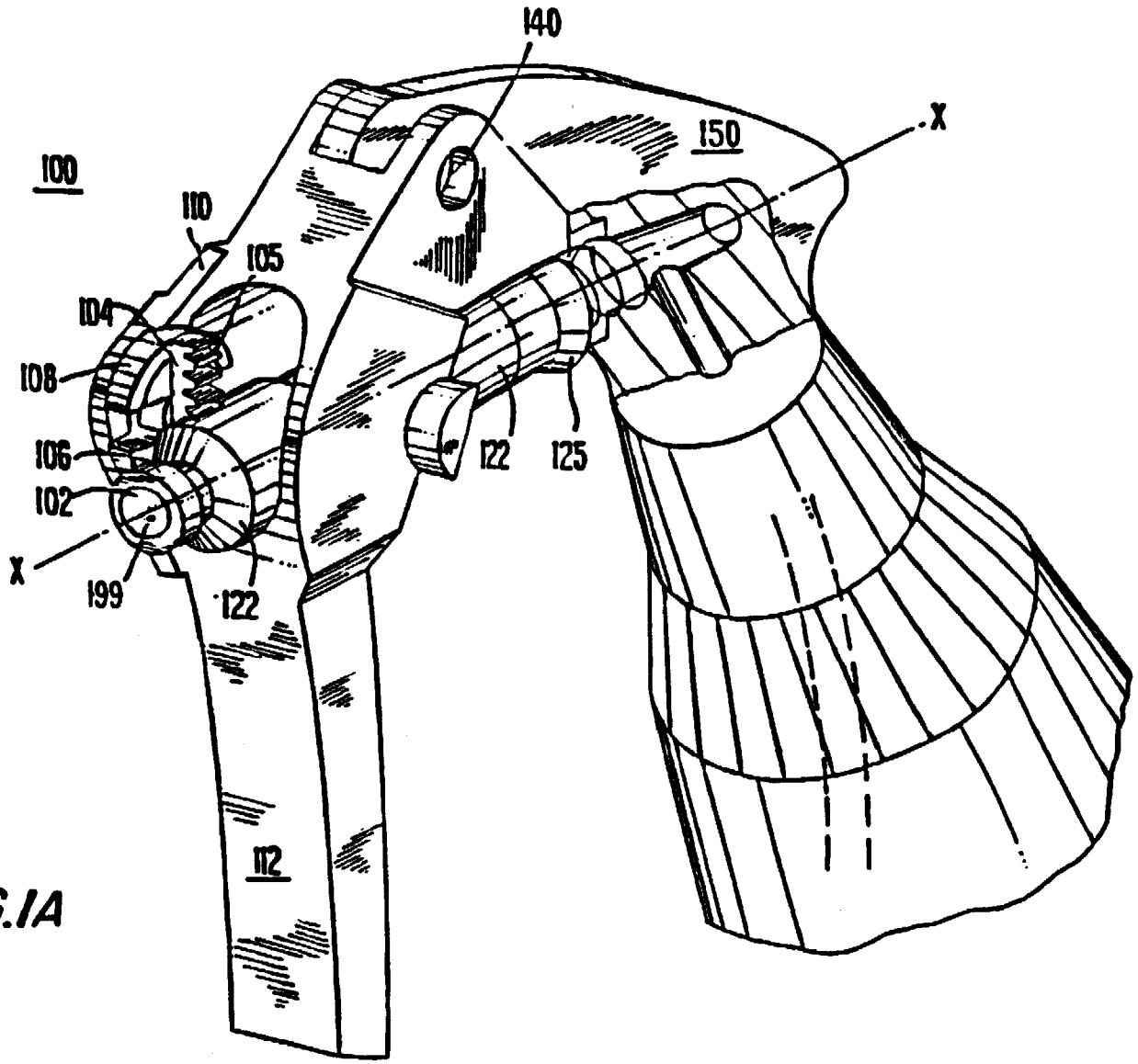
FIG. 1A is a perspective view of an alternative embodiment of the hand held sprayer according to the invention.
Figure 2:
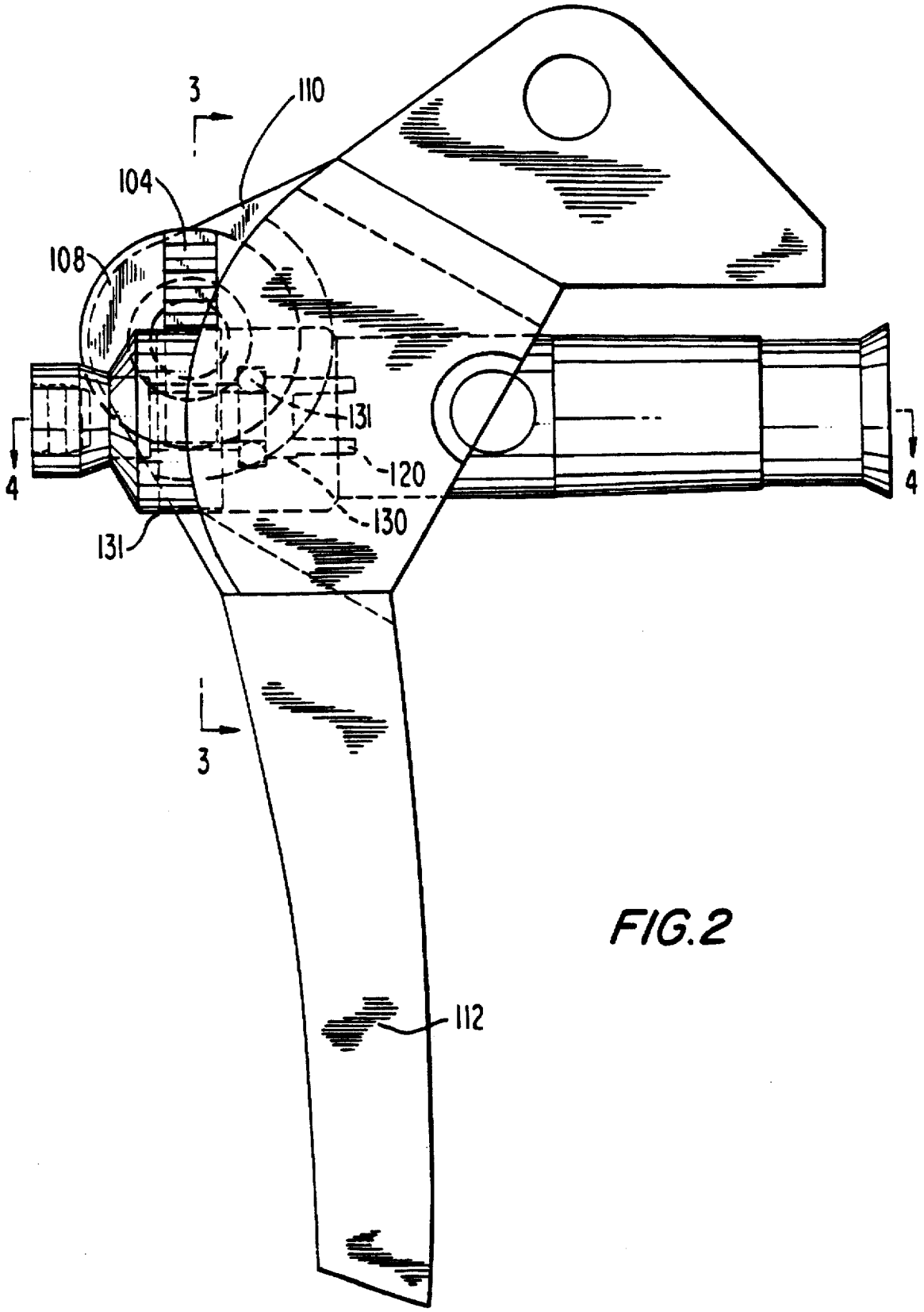
FIG. 2 is a side view of FIG. 1.
Figure 3:
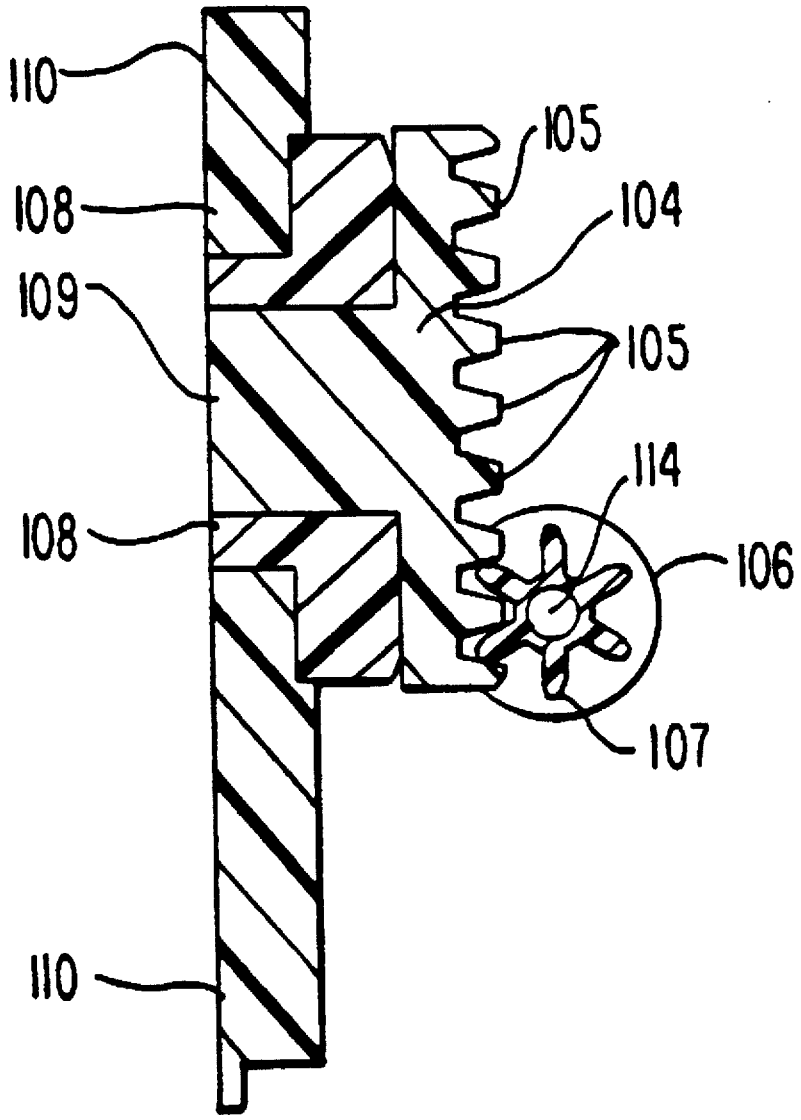
FIG. 3 is a partial sectional view through 3—3 of FIG. 2 to show the arrangement of the rack and pinion with the pinion retainer removed.
Figure 4:
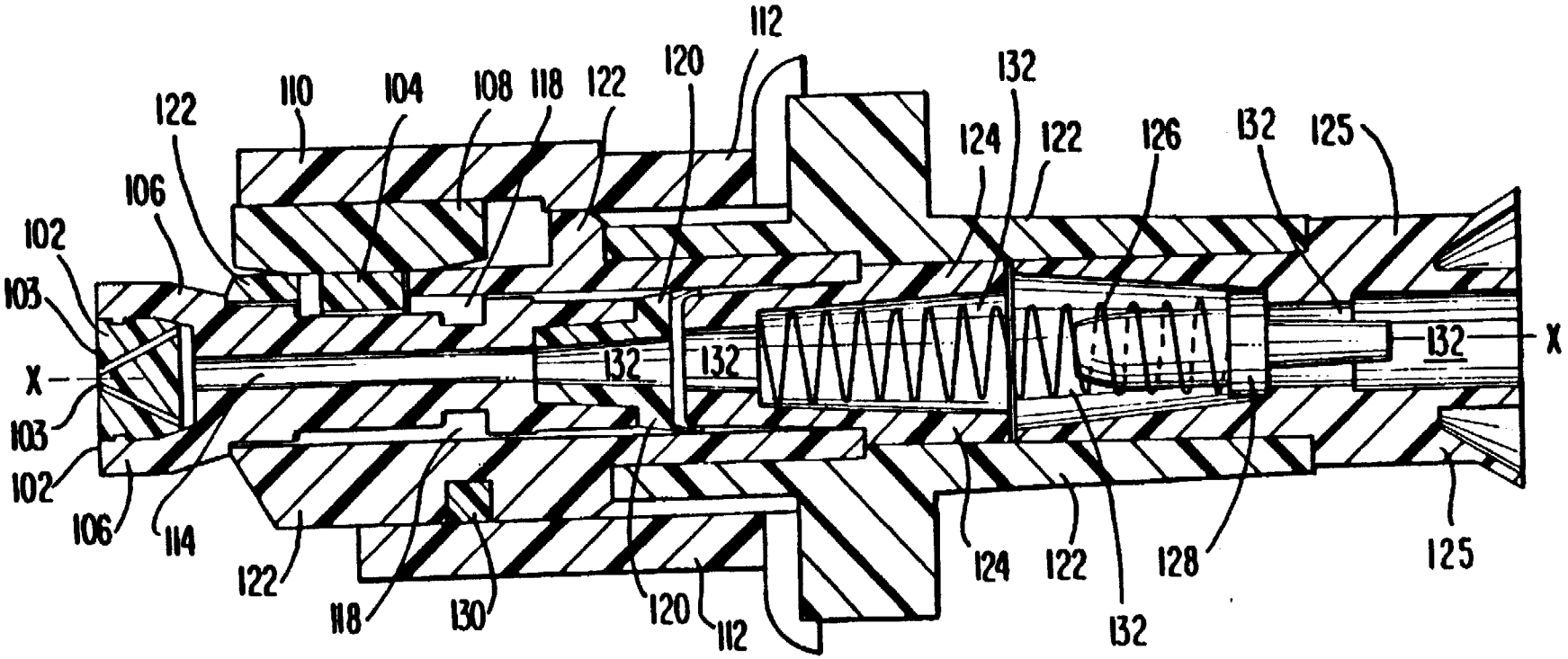
FIG. 4 is a sectional view through 4—4 of FIG. 2.
Figure 5A:
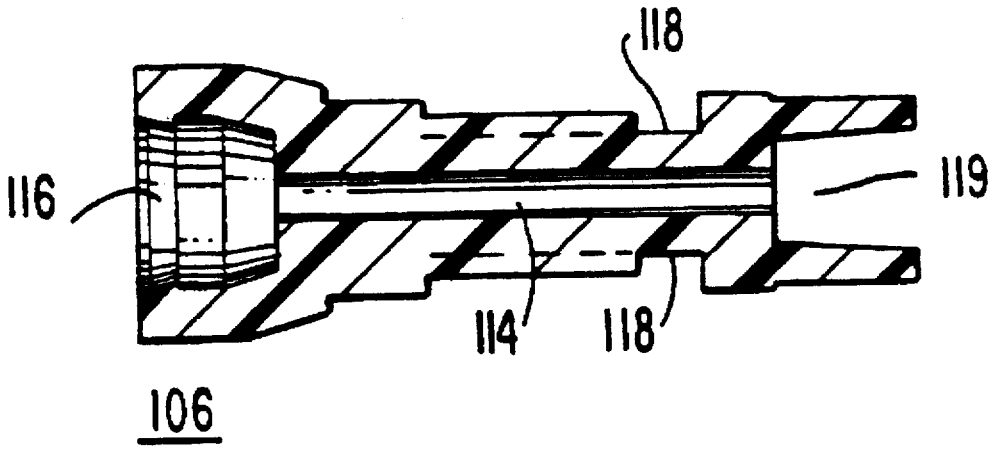
FIG. 5A is a sectional top view of the pinion assembly through 5A—5A of FIG. 5.
Figure 5:
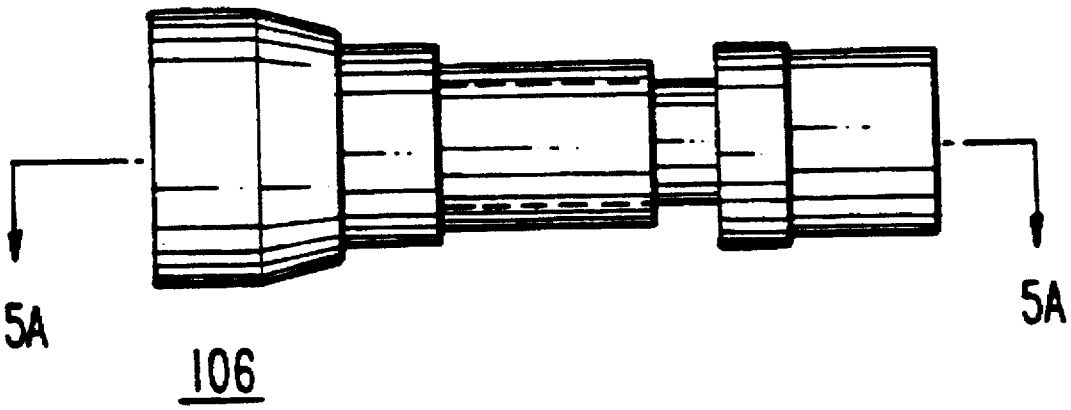
FIG. 5 is a side view of the pinion assembly used in the hand pump sprayer of FIG. 1.
Figure 6:
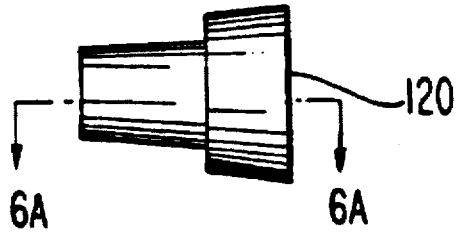
FIG. 6 is the pinion seal used in the hand pump sprayer of FIG. 1.
Figure 6A:
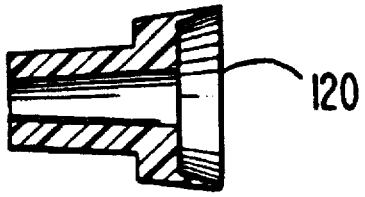
FIG. 6A is a sectional view through 6A—6A of the pinion seal of FIG. 6.
Figure 7:
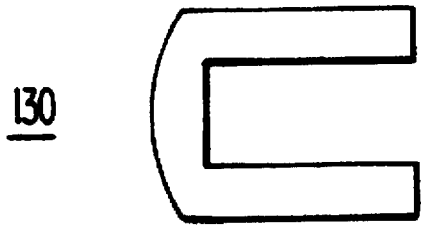
FIG. 7 is a side view of the U-shaped retainer used in the hand pump sprayer of FIG. 1.
Figure 8A:
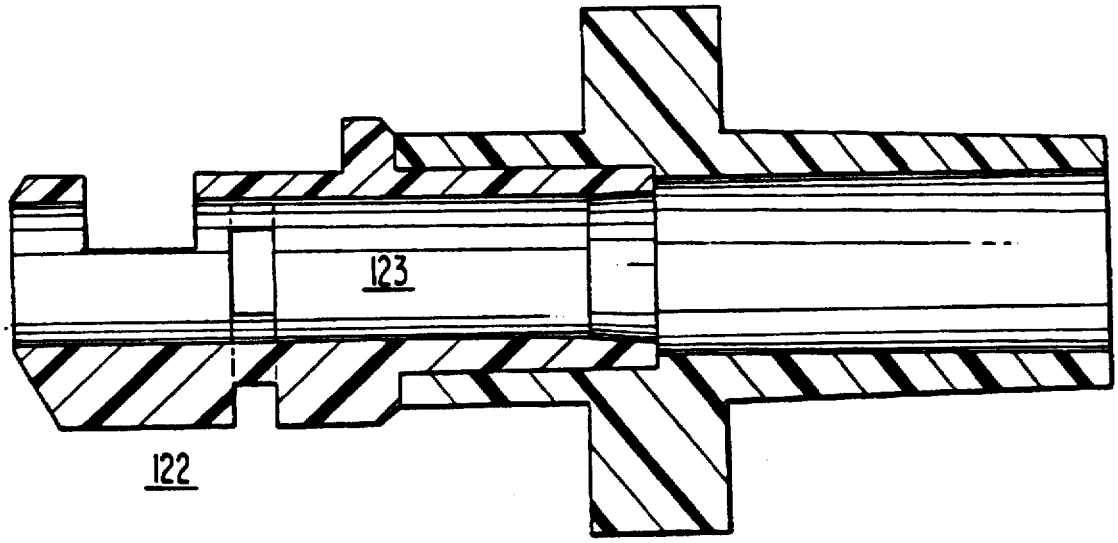
FIG. 8A is a sectional view of FIG. 8 through 8A—8A.
Figure 8:
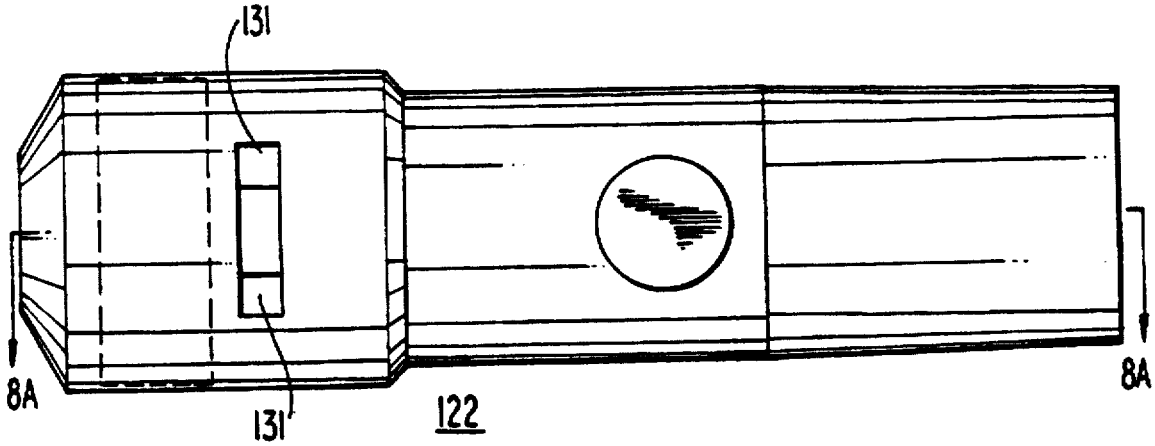
FIG. 8 is a side view of the plunger used in the hand pump sprayer of FIG. 1.
Figure 9:
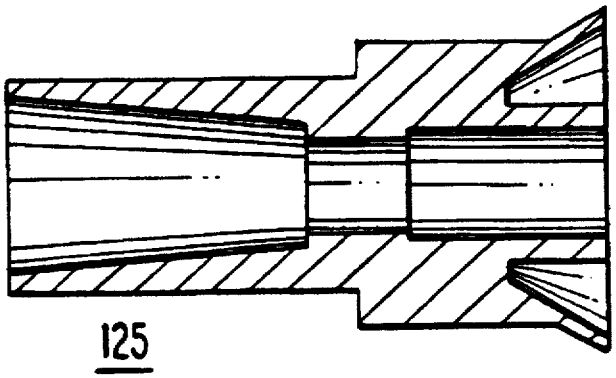
FIG. 9 is a sectional view of the plunger seal used in the hand pump sprayer of FIG. 1.
Figure 10:
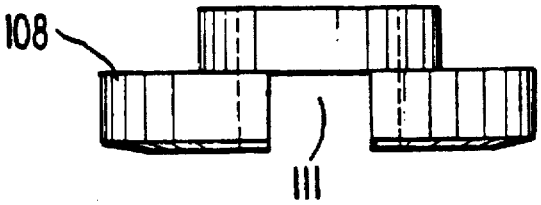
FIG. 10 is a side view of the rack positioner of the hand pump sprayer of FIG. 1.
Figure 10A:
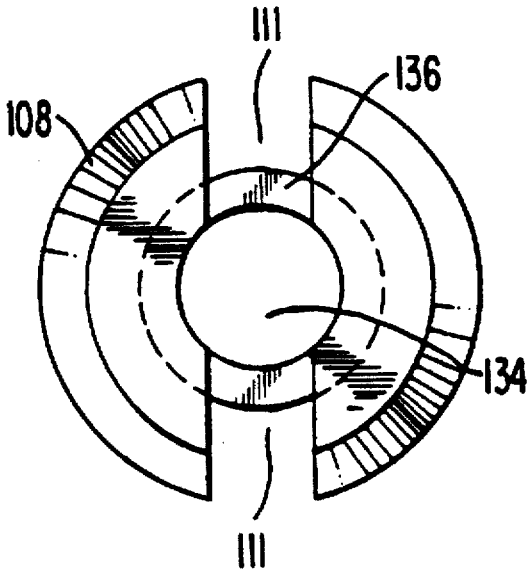
FIG. 10A is a front view of the rack positioner.
Figure 11:
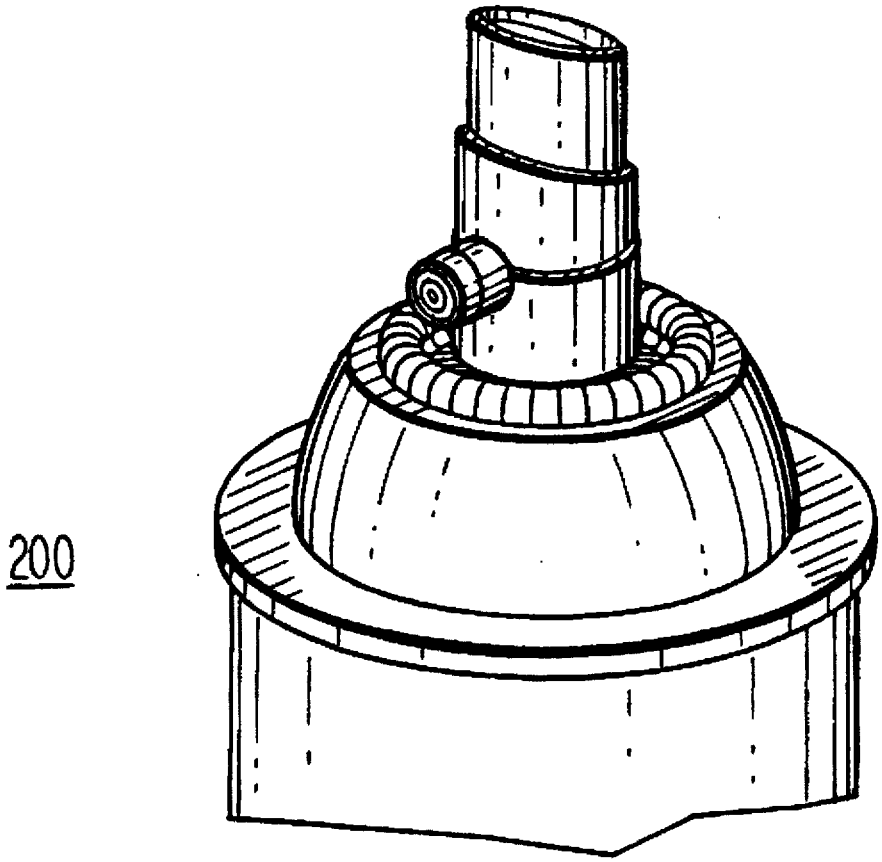
FIG. 11 is a perspective view of an aerosol spray dispenser according to the invention.
Figure 12:
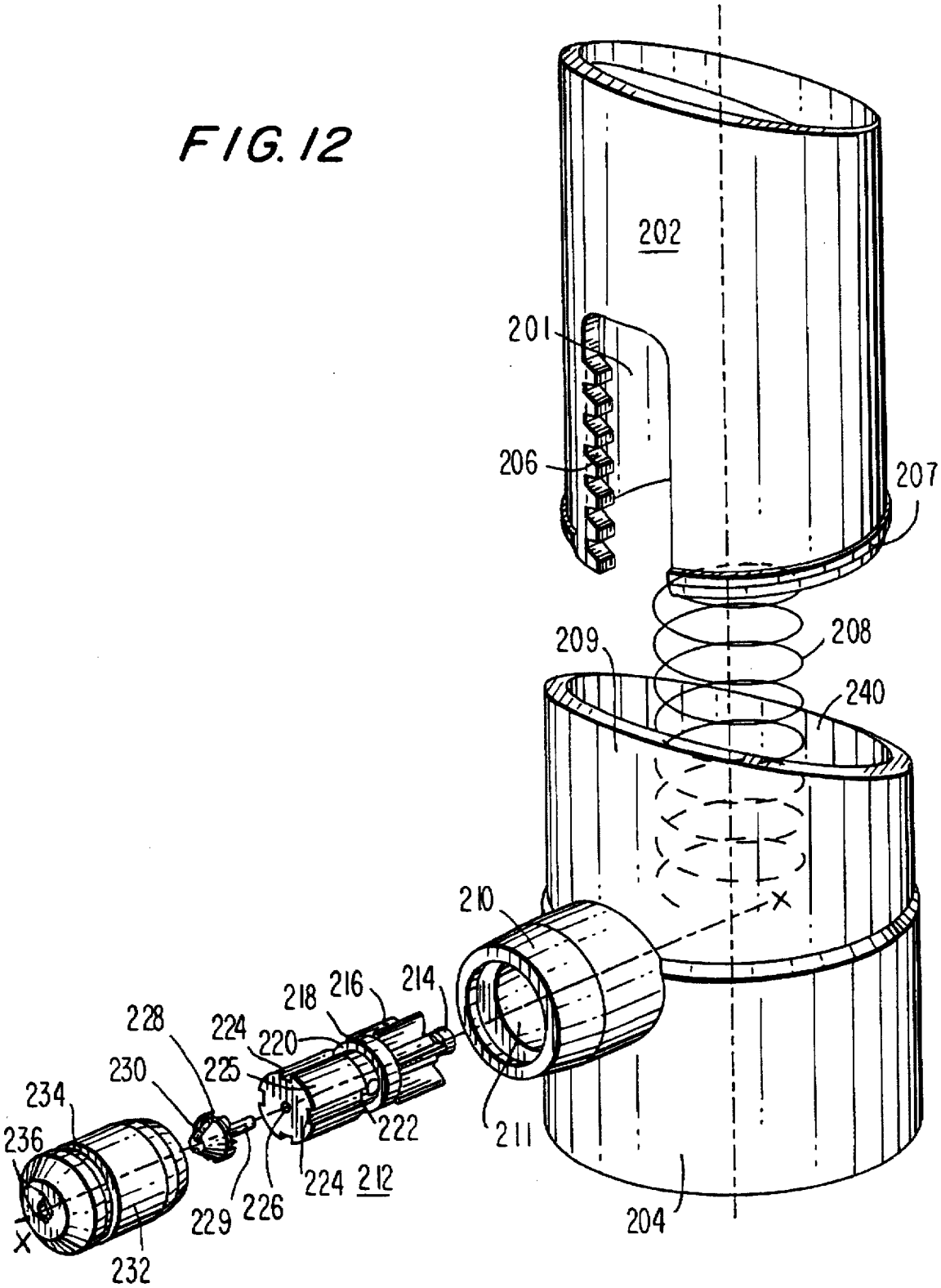
FIG. 12 is an exploded view of a portion of the aerosol dispenser of FIG. 11.
Figure 13:
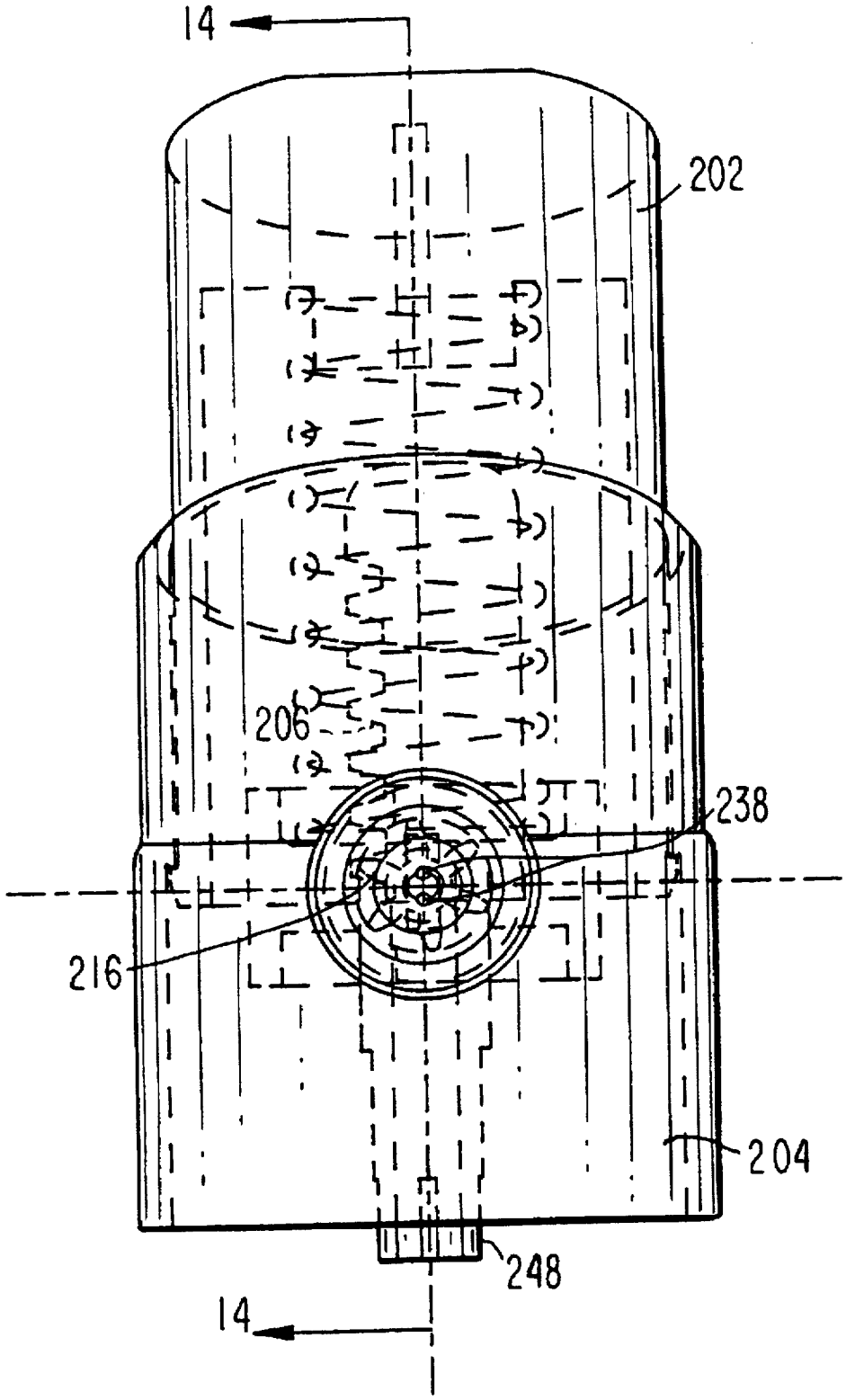
FIG. 13 in a partial front view of the aerosol dispenser of FIG. 11.

Referring to FIGS. 1 to 10, a hand pump sprayer 100 is provided with trigger 112 which is pivotly connected to pump housing 150 through pin 140. A nozzle 102 having angular outlets 103 for discharging fluid from the hand pump sprayer in colliding streams is provided, preferably as described in U.S. Pat. No. 5,088,649 (Hanson). Optionally, as shown n FIG. 1A, a single outlet 199 located eccentric to axis X is provided. A rack 104 having rack teeth 105 is held in place by rack positioner 108. The rack 104 can be disengaged by rotating rack positioner 108 about boss 136 in rack retainer 110 until rack positioner slot 111 is aligned with rack 104. Rack 104 then slides into slot 111. In such position, the nozzle 102 will not rotate. Rack retainer 110 is mounted to trigger 112 and holds the rack positioner 108 and the rack 104 in place. It should be understood that alternatively the rack 104 could be integral with the trigger 112 e.g., molded or the like. Nozzle drive gear preferably pinion assembly 106 having pinion teeth 107 is provided for engagement with rack 104. Pinion assembly 106 is axially aligned with nozzle 102. As best seen in FIG. 4 and FIG. 5A, nozzle 102 is snap mounted into nozzle housing 116 in pinion assembly 104. Pinion assembly fluid passageway 114 is provided through the middle of the generally cylindrically pinion assembly 106 and brings fluid to the nozzle 102. As best seen in FIG. 4 and FIG. 6, pinion seal 120 is provided for mounting in the inlet end of the pinion assembly 106 in bore 119. As shown in FIG. 4 and FIG. 8A pinion assembly 106 slides into generally cylindrical plunger 122 through plunger hollow 123. Pinion assembly 106 is held in place by U-shaped pinion retainer 130 which slides through holes 131 in plunger 122 and bares against circular groove 118 in the outside wall of pinion assembly 106 to thereby securely interconnect the pinion assembly 106 to the plunger 122. Adjacent the pinion assembly 106 within the plunger hollow 123 is pinion assembly seal 120. The seal 120 prevents fluid leakage around the pinion assembly 106. Adjacent the pinion assembly seal 120 is check valve spring retainer 124 for receipt and retention of spring 126. A conventional check valve 128 is located within plunger hollow 123 adjacent to spring 126. Adjacent to plunger 122 is plunger seal 125 to present leakage from the plunger 122. The fluid passageway 132 extends through the entire assembly and brings fluid to pinion fluid passageway 114 from the reservoir. Fluid passageway 132 is then interconnected in a conventional manner to the reservoir through a dipstick or the like not shown.

In operation the liquid is pumped by the action of the trigger and plunger liquid is brought from the reservoir to the delivery passageway in a conventional manner, see for example, U.S. Pat. Nos. 4,646,969 or 3,927,834. As the trigger is pulled the rack 104 moves back and forth simultaneously with the pulling of the trigger 112 and rotates the pinion assembly 106 which in turn simultaneously rotates the nozzle located in the nozzle housing 116 in the pinion assembly 106. As a result, liquid is drawn from the reservoir through the delivery passageway which is composed of pinion assembly fluid passageway 114 and fluid passageway 132 expelled under pressure to the atmosphere through the nozzle outlets in colliding streams. Simultaneously with the discharge of the fluid from the nozzle, the nozzle rotates through an angle of 90° to 360° , preferably from 180° to 360° and most preferably 270° or more. The resulting fluid preferably a viscous liquid having a viscosity of 60 to 100 cps, most preferably from 60 to 85 cps is discharged in a fine mist in a circular pattern. When the rack is moved back and forth the pinion assembly 106 is rotated by the rack and rotates the nozzle 102 which is snap fitted into the nozzle housing 116. The rack rotates the pinion assembly 106 and the nozzle 102 about an axis X of rotation through the center of the discharge end of the nozzle through an angle of rotation of from 90° to 360° preferably from 180° to 360° and most preferably 270° or more.

It should be understood that alternative methods of rotating the nozzle are contemplated by the invention. For example, the nozzle drive gear can be driven indirectly by the actuator through several interconnected gears. Alternatively, the nozzle could be rotated by the pressure of the expelled fluid.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

I claim:

1. A spray dispenser wherein fluid is brought from a reservoir to the outlet of a delivery passageway comprising:

a nozzle having a nozzle inlet, nozzle outlet means and a nozzle center;

said nozzle inlet in fluid communication with said outlet of said delivery passageway;

said nozzle rotatably mounted to said spray dispenser for rotation of said nozzle from 90° to 360° about an axis X of rotation through the nozzle center;

a fluid dispensing actuator for selectively dispensing fluid to the atmosphere;

nozzle rotation means to rotate said nozzle simultaneously with the dispensing of the fluid to the atmosphere.

2. A closed pressurized spray dispenser wherein fluid is brought from a reservoir to the outlet of a delivery passageway comprising:

a nozzle having a nozzle inlet, a nozzle outlet means and a nozzle center; said nozzle inlet in fluid communications with said outlet of said delivery passageway;

said nozzle rotatably mounted to said delivery passageway for rotation of said nozzle from 90° to 360° about an axis X of rotation through the nozzle center;

a fluid dispensing actuator interconnected to said nozzle to rotate said nozzle around axis X of rotation simultaneously with the dispensing of the fluid to the atmosphere, upon engagement of said actuator.

3. A spray dispenser according to claim 2 wherein said closed pressurized spray dispenser is a hand held aerosol can and said fluid dispensing actuator is an aerosol button.

4. A hand held hand pump spray dispenser according to claim 1 wherein said fluid dispensing actuator is interconnected to said nozzle to rotate said nozzle around said axis X of rotation simultaneously with the dispensing of the fluid to the atmosphere, upon the engagement of said actuator.

5. A spray dispenser according to claim 4 wherein said hand pump spray dispenser is a finger pump dispenser.

6. A spray dispenser according to claim 4 wherein said hand pump spray dispenser is a hand pump trigger sprayer.

7. A spray dispenser according to any one of claims 1, 2 or 5 wherein said rotation of said nozzle is from 180° to 360° .

8. A spray dispenser sprayer according to any one of claims 1, 2 or 5 wherein said rotation of said nozzle is 270° or greater.

9. A spray dispenser according to claims 1, 2 or 5 wherein said reservoir includes a viscous liquid having a viscosity over 60 cps.

10. A spray dispenser according to any one of claims 1,2 or 5 wherein said nozzle outlet means includes a first and second nozzle outlet to discharge liquid to the atmosphere along a first and second discharge axes; said axis intersecting at a collision point exterior to said nozzle.

11. A spray dispenser according to claim 10 wherein first and second outlets are located on opposite sides of the axis X of rotation.

12. A spray dispenser according to any one of claims 1,2 or 5 wherein said nozzle outlet means is a single nozzle outlet located eccentrically to the axis X of rotation.

13. A spray dispenser wherein fluid is brought under pressure from a reservoir, to the outlet of a delivery passageway upon engaging an actuator comprising:

a. an actuator interconnected to said reservoir selectively for releasing fluid to the atmosphere;

b. a nozzle having a nozzle inlet and a nozzle outlet means;

c. a delivery passageway in fluid communication with said reservoir and said nozzle;

d. means for delivering said fluid to said delivery passageway when said actuator is engaged;

e. said nozzle rotatably mounted to said spray dispenser for rotation of from 180° to 360° about an axis X through the center of said nozzle;

f. a drive gear interconnected to and operatively driven by said actuator;

g. a nozzle gear operatively connected to said drive gear for rotational movement;

h. said nozzle interconnected to said nozzle drive gear so that said nozzle is rotated by said nozzle drive gear from 180° to 360° about the axis X through the center of said nozzle simultaneously with the dispensing of said pressurized fluid through said nozzle outlet means when said actuator is engaged.

14. A spray dispenser according to claim 13 wherein said nozzle rotates 270° or greater.

15. A spray dispenser according to claim 13 wherein the nozzle outlet means includes a first and second outlet to discharge liquid to the atmosphere along a first and second discharge axis; said axises intersecting at a collision point exterior to said nozzle.

16. A spray dispenser according to claim 15 wherein first and second outlets are located on opposite sides of the axis X of rotation.

17. A spray dispenser according to claim 13 wherein said nozzle outlet means includes a single nozzle outlet located eccentrically to the axis X of rotation.

18. A spray dispenser according to claim 15 wherein said drive gear is a gear rack attached to said actuator;

said nozzle gear is a pinion directly interconnected with gear rack.

19. A spray dispenser according to claim 18 further comprising said pinion axially aligned with said nozzle to rotate said nozzle simultaneously with the rotation of said pinion.

20. A spray dispenser according to claim 19 wherein said pinion includes a nozzle housing for receipt and axial alignment of said nozzle with said pinion.

21. A spray dispenser according to claim 20 wherein said pinion includes a fluid passageway therein interconnecting said delivery passageway to said nozzle.

22. A dispensing system for spray dispensing liquids comprising:

a liquid to be sprayed;

a reservoir for holding said liquid;

a spray dispenser wherein the pressurized liquid is brought from a reservoir, to the outlet of a delivery passageway;

said spray dispenser comprising:

a. an actuator interconnected to said reservoir for delivery of pressurized liquid to the outlet of said delivery passageway;

b. a nozzle having an inlet and an outlet means;

c. a delivery passageway in fluid communication with said reservoir and said nozzle;

d. means for delivering said liquid to said delivery passageway when said actuator is engaged;

e. said nozzle rotatably mounted to said spray dispenser for rotation from 180° to 360° about an axis X through the center of said nozzle;

f. a drive gear interconnected to and operatively driven by said actuator.

23. The dispensing system according to claim 22 wherein said liquid has a viscosity of 60 cps or greater.

24. The dispensing system according to claim 23 wherein said liquid is a viscous vegetable oil containing liquid.

25. The dispensing system according to any one of claims 22, 23 or 24 wherein said spray dispenser is an aerosol container.

26. The dispensing system according to any one of claims 22, 23 or 24 wherein said spray dispenser is a finger pump dispenser.

27. The dispensing system according to claim 22 further comprising;

g. a nozzle gear operatively connected to said drive gear for rotational movement;

h. said nozzle interconnected to said nozzle gear so that said nozzle is rotated by said nozzle drive gear from 180° to 360° about the axis X through the center of said nozzle simultaneously with the dispensing of said pressurized liquid through said nozzle to the atmosphere through said nozzle outlet means when the actuator is engaged.

28. A dispensing system according to claim 27 wherein said liquid is a viscous liquid having a viscosity of 60 cps or greater.

29. A dispensing system according to claim 28 wherein said liquid has a viscosity of from 60 to 100 cps.

30. A dispensing system according to claim 29 wherein said liquid has a viscosity of from 60 to 85 cps.

31. A dispensing system according to claim 29 wherein said viscous liquid is selected from the group consisting essentially of vegetable oil, vegetable oil lecithin mixtures, paint pigments in linseed oil, petroleum products, lubricants, adhesives and resins.

32. A dispensing system according to claim 31 wherein said liquid includes vegetable oil.

33. A dispensing system according to claim 31 wherein said liquid is hair spray resin.

34. A dispensing system according to claim 31 wherein said liquid is a lubricant.

35. A dispensing system according to claim 34 wherein said lubricant is petroleum based.

36. A dispensing system according to claim 29 wherein said drive gear is a gear rack attached to said actuator; and said nozzle gear is a pinion directly interconnected with gear rack.

37. A dispensing system according to claim 28 wherein said nozzle has a first and second discharge outlet to discharge fluids flowing from said nozzle along a first and second discharge axis;

said first and second discharge axises intersecting at a collision point exterior to said nozzle discharge outlets whereby a round spray pattern is obtained.

38. A dispensing system according to claim 37 wherein said nozzle has a single discharge outlet located eccentrically to said axis X of rotation.

* * * * *